US008415597B2

(12) United States Patent
Shin et al.

(10) Patent No.: US 8,415,597 B2
(45) Date of Patent: Apr. 9, 2013

(54) WING ASSEMBLY AND APPARATUS FOR LAUNCHING FLYING OBJECT USING THE SAME

(75) Inventors: Sang Hun Shin, Daejeon (KR); Heon Suk Hong, Daejeon (KR); Woo Yong Lee, Daejeon (KR)

(73) Assignee: Agency for Defense Development, Daejeon (KR)

( * ) Notice: Subject to any disclaimer, the term of this patent is extended or adjusted under 35 U.S.C. 154(b) by 329 days.

(21) Appl. No.: 12/779,346

(22) Filed: May 13, 2010

(65) Prior Publication Data

US 2010/0294879 A1 Nov. 25, 2010

(30) Foreign Application Priority Data

May 19, 2009 (KR) ..... 10-2009-0043676

(51) Int. Cl.
*F42B 10/00* (2006.01)

(52) U.S. Cl.
USPC ..... 244/3.27; 244/3.29; 244/63; 102/490; 89/1.816

(58) Field of Classification Search ..... 244/3.27, 244/3.29, 63; 102/490; 89/1.816
See application file for complete search history.

(56) References Cited

U.S. PATENT DOCUMENTS 6,314,886 B1 * 11/2001 Kuhnle et al. ..... 244/3.28
6,439,304 B2 * 8/2002 Eaton ..... 166/241.6

* cited by examiner

*Primary Examiner* — J. Woodrow Eldred
(74) *Attorney, Agent, or Firm* — Scully, Scott, Murphy & Presser, P.C.

(57) ABSTRACT

Disclosed are a wing assembly including a wing movably accommodated in a launch tube, and a buffer unit detachably mounted to the wing to come in contact with the launch tube and configured to be separated from the wing after the wing comes out of an inner space of the launch tube, and an apparatus for launching a flying object having the same.

6 Claims, 3 Drawing Sheets

WING ASSEMBLY AND APPARATUS FOR LAUNCHING FLYING OBJECT USING THE SAME

CROSS-REFERENCE TO RELATED APPLICATION

Pursuant to 35 U.S.C. §119(a), this application claims the benefit of earlier filing date and right of priority to Korean Application No. 10-2009-0043676, filed on May 19, 2009, the contents of which is incorporated by reference herein in its entirety.

BACKGROUND OF THE INVENTION

1. Field of the Invention

The present invention relates to a wing assembly having a structure of buffering collision between wings and part of a launch tube and an apparatus for launching a flying object using the same.

2. Background of the Invention

Guided weapons such as guided missiles are initially accommodated in a launch tube and then launched by manipulation to come out of the launch tube. In the accommodated state, wings may be folded within the launch tube in order to minimize an inner diameter of the launch tube.

The wings within the launch tube partially make friction due to collision onto an inner wall of the launch tube, having the chance of causing damages on the wings or launch tube.

To obviate such damages, an employment of a member for buffering such collision may be considered.

SUMMARY OF THE INVENTION

To solve the problem, an object of the present invention is to provide a wing assembly having a mechanism allowing a different buffering from the related art, and an apparatus for launching a flying object having the same.

Another object of the present invention is to provide a structure in which a buffering mechanism is separated from wings after the wings come out of a launch tube.

To achieve those objects and other advantages in accordance with one embodiment of the present invention, a wing assembly may include a wing movably accommodated in a launch tube, and a buffer unit detachably coupled to the wing to come in contact with an inner wall of the launch tube. The buffer unit may be configured to buffer impacts due to collision between the launch tube and the wing, and be separated after the wing comes out of an inner space of the launch tube.

In accordance with one aspect of the present invention, the wing may rotate centering around one shaft after the separation, and the buffer unit may be separated by the rotational force.

In accordance with another aspect of the present invention, the buffer unit may include a contact portion coming in contact with the inner wall, and a coupled portion coupled to the wing by being inserted into a coupling groove formed at the wing. The contact portion may be made of a non-metallic lubricant material, such as teflon, polyamide or the like, and the coupled portion may be made of a metal, such as aluminum, for enhancing a coupling intensity.

In accordance with another aspect of the present invention, the wing assembly may further include an elastic member having one end supported by the buffer unit and another end supported by the wing, and configured to apply an elastic force such that the buffer unit moves away from the wing.

In accordance with another embodiment of the present invention, there is provided an apparatus for launching a flying object, the apparatus including a launch tube, a fuselage, wings and a buffer unit. The launch tube may have an inner space in a form extending in a lengthwise direction. The fuselage may be accommodated within the inner space so as to be launched from the launch tube is along the lengthwise direction. The wings may be installed at the fuselage to be deployable after rotation centering around one shaft. The buffer unit may detachably be coupled to each of the wings to come in contact with an inner wall of the launch tube and separated from the wing by a deployment force of the wing after the fuselage is launched.

In accordance with one aspect of the present invention, the buffer unit may include a contact portion coming in contact with the inner wall, and a coupled portion coupled to the wing by being inserted into a coupling groove formed at the wing.

In accordance with another aspect of the present invention, the apparatus may further include an elastic member having one end supported by the buffer unit and another end supported by the wing, and configured to apply an elastic force such that the buffer unit moves away from the wing.

In accordance with another aspect of the present invention, the wing may include a fixed portion fixed to the fuselage, and a rotating portion coupled to the fixed portion to be rotatable centering around the shaft. An elastic force supplier may be provided at the rotating portion so as to apply an elastic force, such as torsion, to the rotation of the rotating portion.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
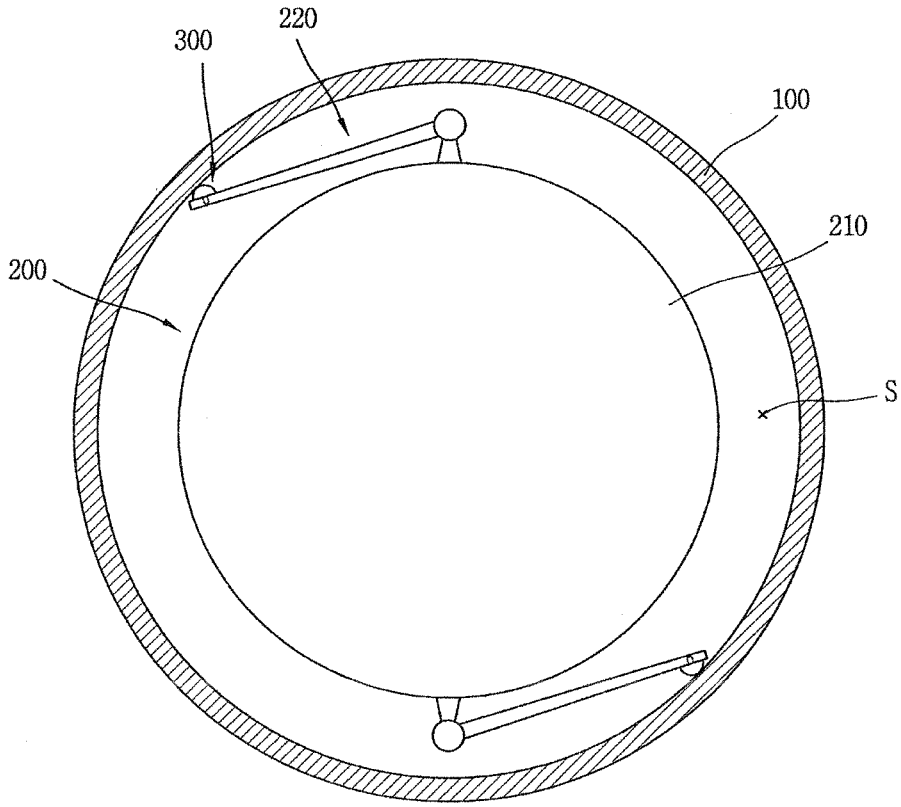
FIG. 1 is a cross-sectional view illustrating an apparatus for launching a flying object in accordance with one embodiment of the present invention.

Hereinafter, description will be given in detail of a wing assembly and an apparatus for launching a flying object using the same in accordance with one embodiment of the present invention, with reference of the accompanying drawings. The specification may specify the like/similar components with the like/similar reference numerals even in different embodiments, so the description thereof will be understood by the first description.

FIG. 1 is a cross-sectional view illustrating an apparatus for launching a flying object in accordance with one embodiment of the present invention.

Referring to FIG. 1, the apparatus for launching the flying object may is include a launch tube 100, a flying object 200 and a buffer unit 300.

The launch tube 100 may be installed in fighters or battleships, and structurally have a form of hollow sphere extending in a lengthwise direction. The hollow portion may define an inner space S for accommodating the flying object 200. An inner wall of the launch tube 100 defining the inner space S may face the flying object 200.

The inner space S may be defined to accommodate the flying object 200, such as a guided missile, in a standby state. The flying object 200 may include a fuselage 210 extending in the same direction as the lengthwise direction of the launch tube 100, and wings 220 protruding to an outer circumference of the fuselage 210 in a coupled state. When the flying object 200 is held in the inner space S, the wings 220 may be accommodated in a folded state. Consequently, a diameter of the inner space S may be minimized and additionally an overall size of the launch tube 100 can be reduced.

The folded wings 220 and the inner wall of the launch tube 100 may collide onto each other by being shaken (vibrated) in response to movement of fighters, battleships or vehicles. To buffer impacts caused due to such collision, the buffer unit 300 may be provided at each wing 220. A free end of the buffer unit 300 may come in contact with the inner wall of the launch tube 100. The wing 220 and the corresponding buffer unit 300 may be referred to as a wing assembly.

Figure 2A:
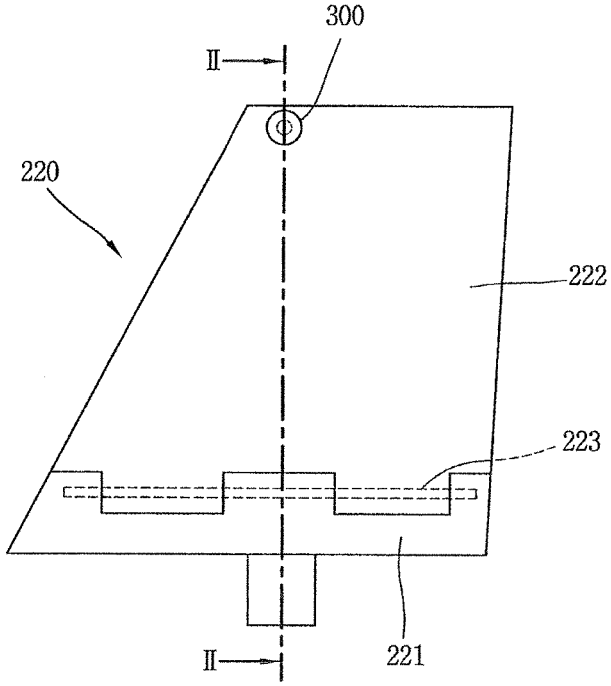
FIG. 2*a* is a front view of a wing assembly illustrated in FIG. 1.
Figure 2B:
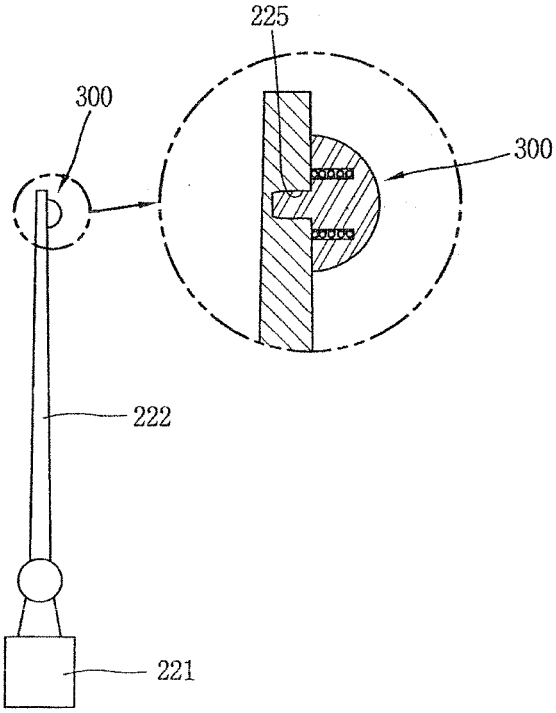
FIG. 2*b* is a sectional view taken along the line II-II of FIG. 2*a;*

FIG. 2*a* is a front view of the wing assembly illustrated in FIG. 1, and FIG. 2*b* is a sectional view taken along the line II-II of FIG. 2*a*.

As illustrated in FIG. 2*a*, each of the wings 220 may include a fixed portion 221 fixed to the fuselage 210 (see FIG. 1), and a deploying portion 222 rotatably coupled by the fixed portion 221. A portion of the wing 220 which is folded upon being accommodated in the launch tube 100 (see FIG. 1) corresponds to the deploying portion 222. An elastic force supplier 223 for allowing an elastic deployment of the deploying portion 222 may be formed at a hinge portion for connecting the fixed portion 221 to the deploying portion 222. The elastic force supplier 223 may include, for example, a torsion bar or a torsion spring, and allow the deploying portion 222 to be biased from the folded state (see FIG. 1) to a deployed state (see FIG. 2*a*).

The buffer unit 300 may be coupled to the deploying portion 222 of the wing 220. To this end, the deploying portion 222 may be provided with a coupling groove 225 in which the buffer unit 300 is accommodated to be coupled.

Figure 3:
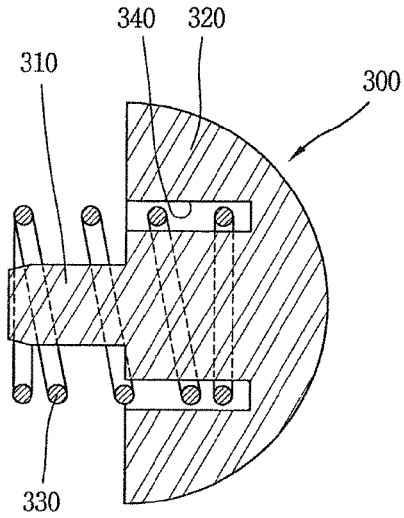
FIG. 3 is an enlarged sectional view of a buffer unit illustrated in FIG. 1.

FIG. 3 is an enlarged sectional view of the buffer unit 300 illustrated in FIG. 1.

As illustrated in FIG. 3, the buffer unit 300 may include a coupled portion inserted into the coupling groove 225 of the wing 220, and a contact portion 320 coming in contact with the inner wall of the launch tube 100. This embodiment illustrates that the coupled portion 310 extends opposite to the contact portion 320 and the contact portion 320 is in a hemispheric form.

The coupled portion 310 may be made of a metal, for example, aluminum, steel or the like, for reinforcing the assembly with respect to the wing 220 and the intensity for assembling. On the other hand, the contact portion 320 may be made of a material having a good lubricant characteristic for reducing friction with the inner wall of the launch tube 100. In addition, the contact portion 320 may preferably be made of a material having a good abrasion resistance as well as the lubricant characteristic to avoid generation of residue upon friction with the inner wall. Examples of such material may include teflon, MC nylon, polyamide and the like.

For coupling the coupled portion 310 to the contact portion 320 made of different materials from each other, the contact portion 320 may be recessed so as to press-fit the coupled portion 310 into the recess. Also, a screw thread may be formed in the recess so as to couple the coupled portion 310 to the contact portion 320 by use of a screw. Alternatively, the coupled portion 310 and the contact portion 320 may be made of the same material so as to be integrally formed together.

The buffer unit 300 may further include an elastic member 330. The elastic member 330 may be disposed to cover the coupled portion 310 if it is configured as a coil spring, for example. One end of the elastic member 330 may be supported by the wing 220 and another end thereof may be supported by the contact portion 320. To constantly maintain the disposed state of the elastic member 330, the contact portion 320 may be provided with an accommodation groove 340 for accommodating the another end of the elastic member 330.

Figure 4:
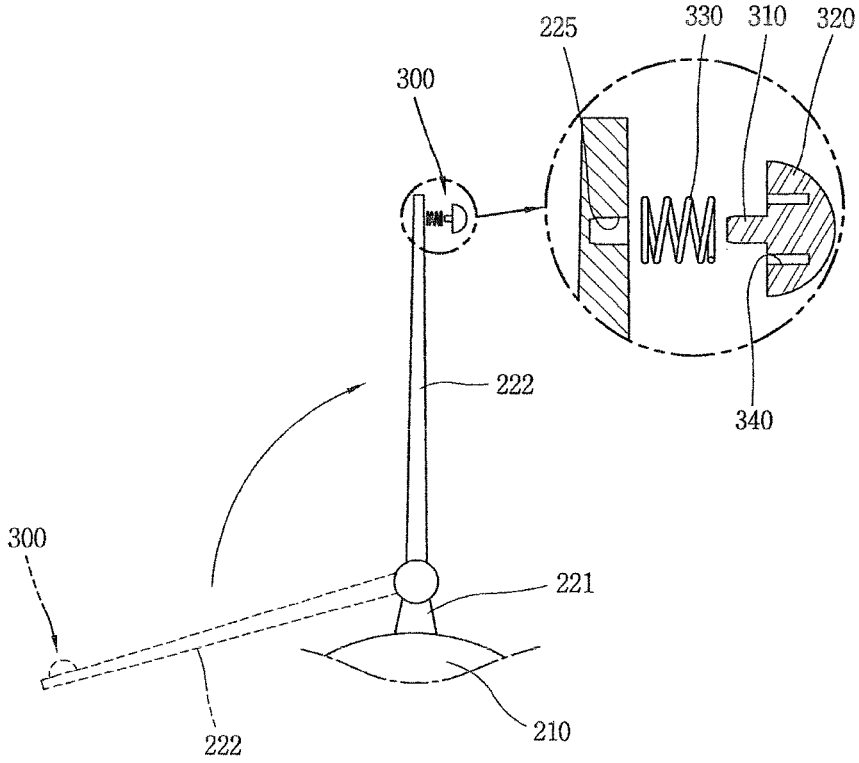
FIG. 4 is an overview illustrating a mechanism for operating the wing assembly responsive to the wing of FIG. 1 coming out of a launch tube.

FIG. 4 is an overview illustrating a mechanism for operating the wing assembly responsive to the wing 220 of FIG. 1 coming out of the launch tube 100.

Referring to FIG. 4 (and FIG. 3), when the flying object 200 (see FIG. 1) moves with being hidden in the launch tube 100, the buffer unit 300 is slid along the inner wall of the launch tube 100 to buffer impacts due to the collision between the wing 220 and the launch tube 100.

When the flying object 200 comes out of the launch tube 100, the deploying portion 222 of the wing 220 is deployed by the elastic force supplier 223 (see FIG. 2*a*). Consequently, the deploying portion 222 rotates centering around a shaft cooperating with the elastic force supplier 223.

When the deploying portion 222 is stopped at the deployment position after the rotation, the buffer unit 300 is separated out of the coupling groove 225 of the deploying portion 222 by an inertial force responsive to the rotation. Here, the is elastic member 330 is tensioned from an elastically compressed state so as to help the separation.

By virtue of the separation mechanism, the buffer unit 300, which has completely performed the buffering function in the standby state of the flying object within the launch tube 100, is separated from the flying object 200, thereby not unnecessarily remaining within the flying object 200.

In accordance with the wing assembly and the apparatus for launching the flying object having the same of the present invention, as the buffer unit detachably coupled to the wing to be located between the launch tube and the wing can be configured to be separated from the wing after the wing comes out of the launch tube, the buffer unit can perform a buffering function when the wing is accommodated within the launch tube and also may not add an unnecessary load to the wing after the wing comes out of the launch tube.

The constructions and operation methods of the foregoing embodiments and advantages of the wing assembly and the apparatus for launching the flying object having the same are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be to combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A wing assembly comprising:

a wing movably accommodated in a launch tube;

a buffer unit detachably mounted to the wing to come in contact with the launch tube and configured to be separated from the wing after the wing comes out of an inner space of the launch tube;

wherein the wing rotates centering around a shaft after the separation, and the buffer unit is separated from the wing by a force responsive to the rotation, and an elastic member having one end supported by the buffer unit and another end supported by the wing and configured to apply an elastic force such that the buffer unit moves away from the wing.

2. The wing assembly of claim 1, wherein the buffer unit comprises:

a contact portion coming in contact with an inner wall of the launch tube; and a coupled portion coupled to the wing by being inserted into a coupling groove formed at the wing.

3. The wing assembly of claim 2, wherein the contact portion is made of a non-metallic lubricant material, and the coupled portion is made of a metal.

4. An apparatus for launching a flying object, the apparatus comprising:

a launch tube having an inner space in a form extending in a lengthwise direction;

a fuselage accommodated within the inner space to be launched from the launch tube along the lengthwise direction;

a wing installed at the fuselage to be deployable after rotating centering around a shaft;

a buffer unit detachably coupled to the wing to come in contact with an inner wall of the launch tube and configured to be separated from the wing by a deployment force of the wing after the fuselage is launched; and an elastic member having one end supported by the buffer unit and another end supported by the wing and configured to apply an elastic force such that the buffer unit moves away from the wing.

5. The apparatus of claim 4, wherein the buffer unit comprises:

a contact portion coming in contact with an inner wall of the launch tube; and a coupled portion coupled to the wing by being inserted into a coupling groove formed at the wing.

6. The apparatus of claim 4, wherein the wing comprises:

a fixed portion fixed to the fuselage; and a rotating portion coupled to the fixed portion to be rotatable centering around the shaft, wherein an elastic force supplier is provided at the rotating portion to apply an elastic force to rotate the rotating portion.

* * * * *